US007090421B1

(12) United States Patent
Mead et al.

(10) Patent No.: US 7,090,421 B1
(45) Date of Patent: Aug. 15, 2006

(54) APPLICATOR ASSEMBLY FOR COATING FASTENERS

(75) Inventors: William T. Mead, Long Beach, CA (US); Jorge A. Millan, Lawndale, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 609 days.

(21) Appl. No.: 10/602,302

(22) Filed: Jun. 24, 2003

Related U.S. Application Data

(63) Continuation-in-part of application No. 10/373,449, filed on Feb. 24, 2003, now abandoned.

(51) Int. Cl.
*A46B 11/00* (2006.01)

(52) U.S. Cl. ..... 401/140; 401/139; 401/130; 401/266; 15/230.11; 492/13

(58) Field of Classification Search ..... 401/137–140, 401/25, 130, 266; 15/230.11, 244.1, 244.2; 492/13, 19, 28, 30
See application file for complete search history.

(56) References Cited

U.S. PATENT DOCUMENTS

| | | | | | |
|---|---|---|---|---|---|
| 2,329,438 | A | * | 9/1943 | Fiedler, Jr. | 492/19 |
| 2,743,469 | A | | 5/1956 | Ditch | |
| 2,929,089 | A | | 3/1960 | Hall | 15/230 |
| 3,002,213 | A | * | 10/1961 | Lindstrom | 15/244.1 |
| 3,337,899 | A | | 8/1967 | Rentfrow | |
| 3,384,438 | A | * | 5/1968 | Sherbondy | 401/139 |
| 3,702,739 | A | * | 11/1972 | Rentfrow | 15/230.11 |
| 4,083,078 | A | * | 4/1978 | Shimizu | 15/244.1 |
| 4,183,684 | A | * | 1/1980 | Avery, Jr. | 401/139 |
| 4,975,999 | A | * | 12/1990 | Levy | 15/244.1 |
| D323,409 | S | * | 1/1992 | Giese | 401/140 |
| 5,312,197 | A | * | 5/1994 | Abramson | 401/139 |
| 5,351,356 | A | * | 10/1994 | Townsend, Jr. | 15/244.1 |
| 5,410,773 | A | | 5/1995 | Forkner | 15/230 |
| 6,059,475 | A | * | 5/2000 | Jafarmadar | 401/140 |
| 2003/0021623 | A1 | | 1/2003 | Haper | 401/219 |

* cited by examiner

*Primary Examiner*—Khoa D. Huynh
(74) *Attorney, Agent, or Firm*—Louis L. Dachs

(57) ABSTRACT

A coating applicator assembly is disclosed for coating fasteners ends protruding from a surface of a structure, the fasteners extending a specific distance above the surface. In detail, the applicator assembly includes a handle. A coating member made from open celled compressible foam having a coating transfer surface in a generally W shape is attached to the handle. Preferably, the central V of the W shaped surface has an included angle of between 40 and 50 degrees and a depth of between 65 and 85 percent of the specific distance and the outer surfaces of the W shaped surface extending outward at an angle of between 40 and 50 degrees and the depth of coating member is at least 4 times the depth of the central notch.

11 Claims, 5 Drawing Sheets

FIG. 5
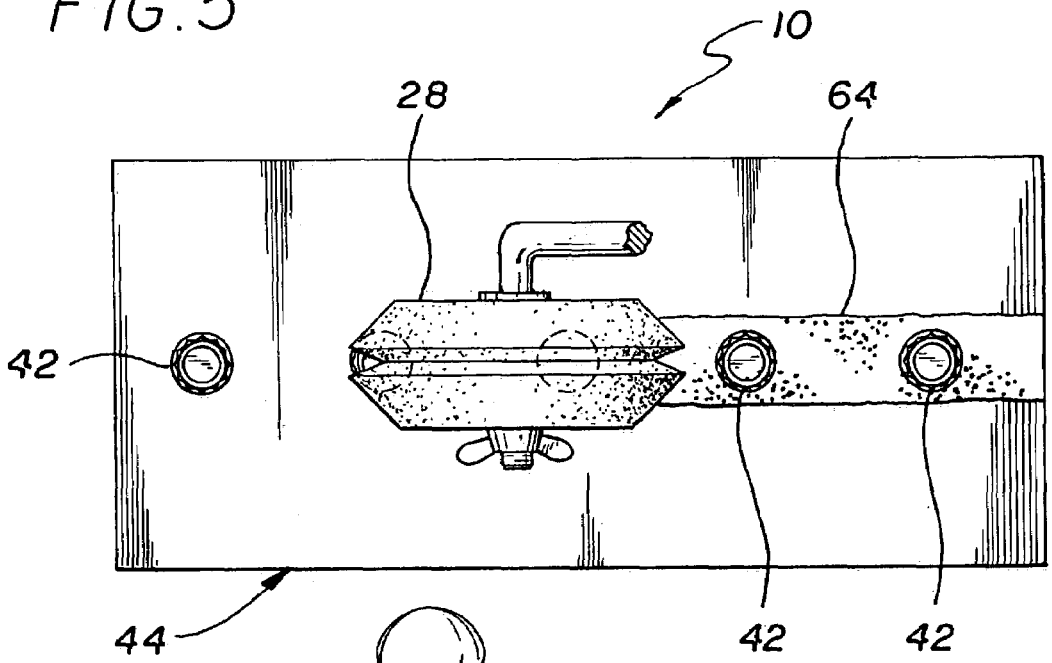
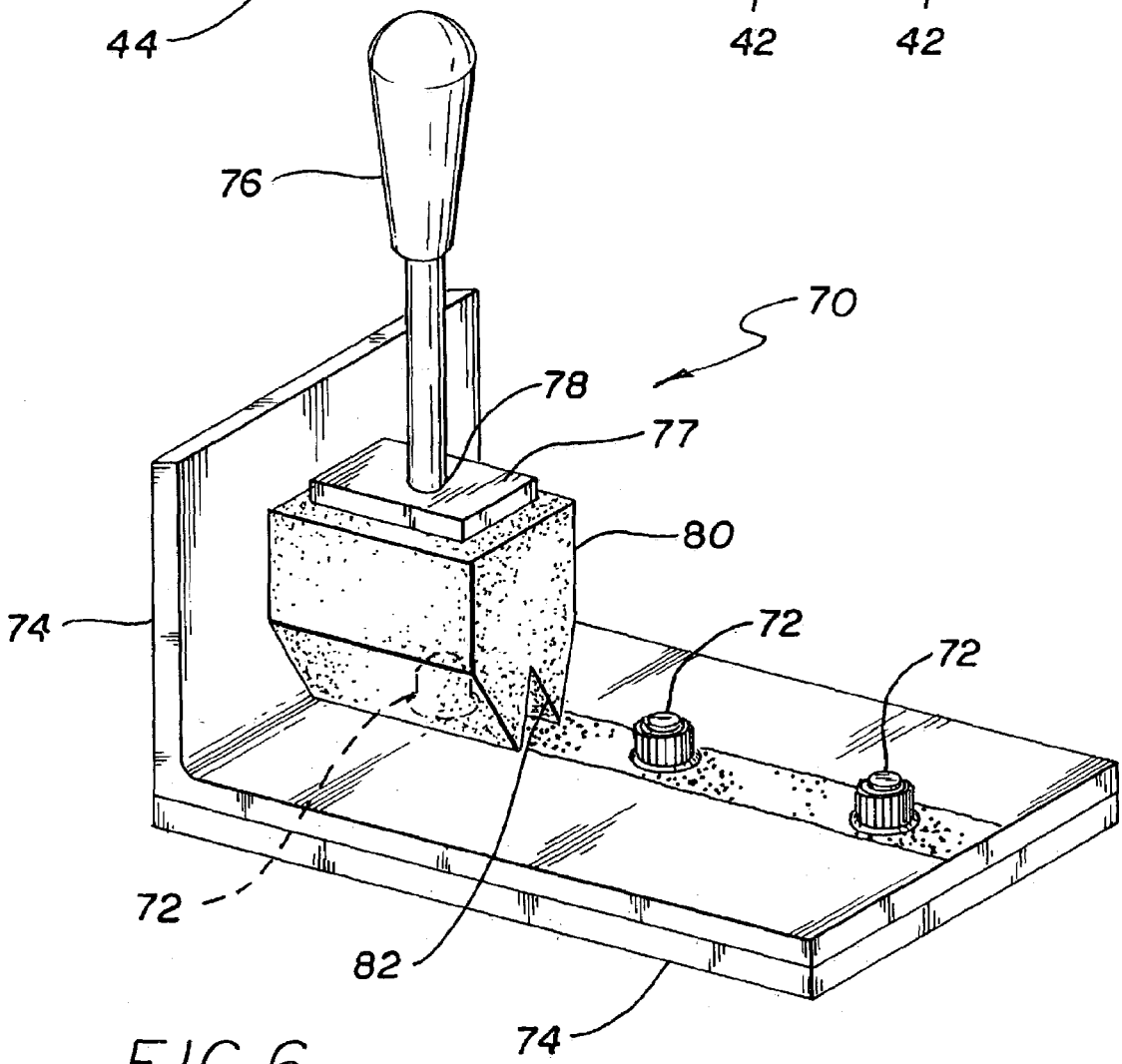
FIG. 6

APPLICATOR ASSEMBLY FOR COATING FASTENERS

RELATED APPLICATIONS

This application is a continuation in part of Applicants' co-pending application Ser. No. 10/373,449 An Applicator Assembly For Coating Fasteners by W. T. Mead, et Al., filed Feb. 24, 2003 now abandoned.

BACKGROUND OF THE INVENTION

1. Field of the Invention

The invention relates to the field of paint applicators and, in particular, to an improved applicator for coating the ends of fasteners protruding from structures.

2. Description of Related Art

In aircraft manufacture most structural elements are joined with fasteners. For corrosion protection, the surfaces of these structural elements are coated with a corrosion inhibiting coating. After assembly, the structural elements must also have the fastener ends (with retaining nuts attached) coated corrosion inhibiting coatings. Spraying on coatings can be used. However, the corrosion inhibiting coatings typically contain chromium compounds and the use of such sprays may cause environmental problems. Brushes can be used, but there use is time consuming. Thus the use of roller applicators becomes one of most effective methods from both environmental and time considerations.

However, prior art roller designs have not been totally effective. A straight roller will not completely cover the fasteners, especially if they are in rows. U.S. Pat. No. 5,410,773 "Pipe Paint Roller" by I. H. Forkner discloses rollers having a U and square shaped notches. These shapes failed to adequately cover in just one pass. In fact, a lot of excess material had to be deposited on the surrounding surfaces before full coverage of the fasteners was accomplished. U.S. Pat. No. 2,929,089 "Paint Applicator For Corners" by W. L. Hall disclosed a roller for corners, with a 90-degree V shaped notch. Tests of this design were also unsuccessful. One of the problems was the shape outer edge collapsed under pressure causing two much of the coating to be deposited on the adjacent surfaces. Thus no prior art applicator design can effectively be used to coat fasteners protruding from a surface.

In addition, it is desirable to eliminate the need for an applicator that does not require that the coating material be imbibed by rolling the coating member in a paint tray. This is a time consuming process. Furthermore, it exposes the user to fumes. Additionally, if the coating material is a two-part system (resin and catalyst) it tends to cure rapidly when exposed to air. Thus once the coating material was poured into the paint tray, it had to be applied immediately.

Coating material applicators having self-contained supply systems are old in the art. They basically comprised a roller assembly connected by a line to a pump/coating reservoir. Coating flow was controlled by turning the pump on and off. Such systems are difficult to use in confined areas. Examples of this type of applicator can be found in US Patent Publication No. US 2003/0021623A1 "Resin Application" by A. R. Harper. The roller handle incorporates a valve to control resin flow to a spreader bar located in proximity to the roller applicator. U.S. Pat. No. 2,743,469 "Roller Type Paint Applicators" by F. D. Ditch discloses a paint roller wherein the rod extending from the handle to the roller axle and the roller axle itself are hollow. A valve mounted in the handle controls paint flow, which is distributed from the axle into the interior of the roller.

There are numerous roller designs wherein the coating material reservoir is contained within the handle. For example, U.S. Pat. No. 3,337,899 "Roller Type Paint Dispenser" by J. M. Rentfrow discloses a device wherein the rod extending from the handle to the roller axle and the roller axle itself are hollow. A reservoir is incorporated into the handle that incorporates a piston biased by a spring that pressurizes the paint therein. A valve is provided for controlling the flow of paint to the roller. However none of these devices disclose a roller applicator suitable for effectively coating the ends of fasteners protruding from a surface.

Thus, it is a primary object of the invention to provide a coating applicator for covering the ends of fasteners protruding from a surface.

It is another primary object of the invention to provide a coating applicator for covering the ends of fasteners protruding from a surface that covers the ends in one pass.

It is a further object of the invention to provide a coating applicator for covering the ends of fasteners protruding from a surface that covers the ends in one pass while applying a minimum amount of coating material to the adjacent surfaces.

It is another object of the invention to provide a coating applicator for covering the ends of fasteners protruding from a surface that covers the ends of fasteners, which has a self contained supply of coating material for providing the coating to the applicator for imbibing thereby.

SUMMARY OF THE INVENTION

In applicants' co-pending patent application Ser. No. 10/373,449 An Applicator Assembly For Coating Fasteners by W. T. Mead, et Al., filed Feb. 24, 2003 disclosed an applicator assembly for coating fasteners ends protruding from a surface of a structure, the fasteners extending a specific distance above the surface. In general terms, the applicator assembly includes a handle to which a coating member is attached made from open celled compressible foam having a coating transfer surface in a generally W shape. In on embodiment the handle includes an axle. A drum is rotatably mounted to the axle. The coating member is in the form of a ring mounted to the drum, the peripheral surface of the ring having the W shape. This embodiment is suitable for coating rows of fasteners.

Preferably, the central notch of the W shape has and included angle of between 40 and 50 degrees. The depth of the notch is between 65 and 85 percent of the specific distance the fastener protrudes from the structure. and the outer surfaces of the W shaped surface extending outward at an angle of between 40 and 50 degrees. The total depth of the coating member must be at least 4 times the depth of central notch. Preferably, the foam is open celled having a density of between 2 and 3 pounds per cubic foot. During coating, such a configuration will allow the coating member to deform sufficiently to completely engulf the fastener end and nut insuring that the imbibed coating material completely coats the fastener end and nut.

The improvement includes attaching a syringe for containing the coating material to the handle of the applicator assembly having a nozzle replacing the needle. The nozzle is positioned such that the tip of just enters the notch and the outlet port of nozzle is aligned with axis of rotation coating member. The advantage of syringe is that coating material remains within the syringe until applied. With the original applicator assembly, a paint tray was necessary. This exposed the operator and any other individuals near by to fumes and possible contact with coating material when handling the tray or pouring coating material therein. In another version, the syringe includes a spring-biased piston, thus pressurizing the coating material. A valve connected to the output port of the syringe controls the flow of coating material to the roller assembly.

The novel features which are believed to be characteristic of the invention, both as to its organization and method of operation, together, with further objects and advantages thereof, will be better understood from the following description in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 5 is a top view of the assembly shown in FIG. 1 applying a coating to a series of fasteners protruding from a structure.

FIG. 6 is a perspective view of a second embodiment applying a coating to a fastener in a corner of a structure.

DESCRIPTION OF THE PREFERRED EMBODIMENT

Figures 1, 2:
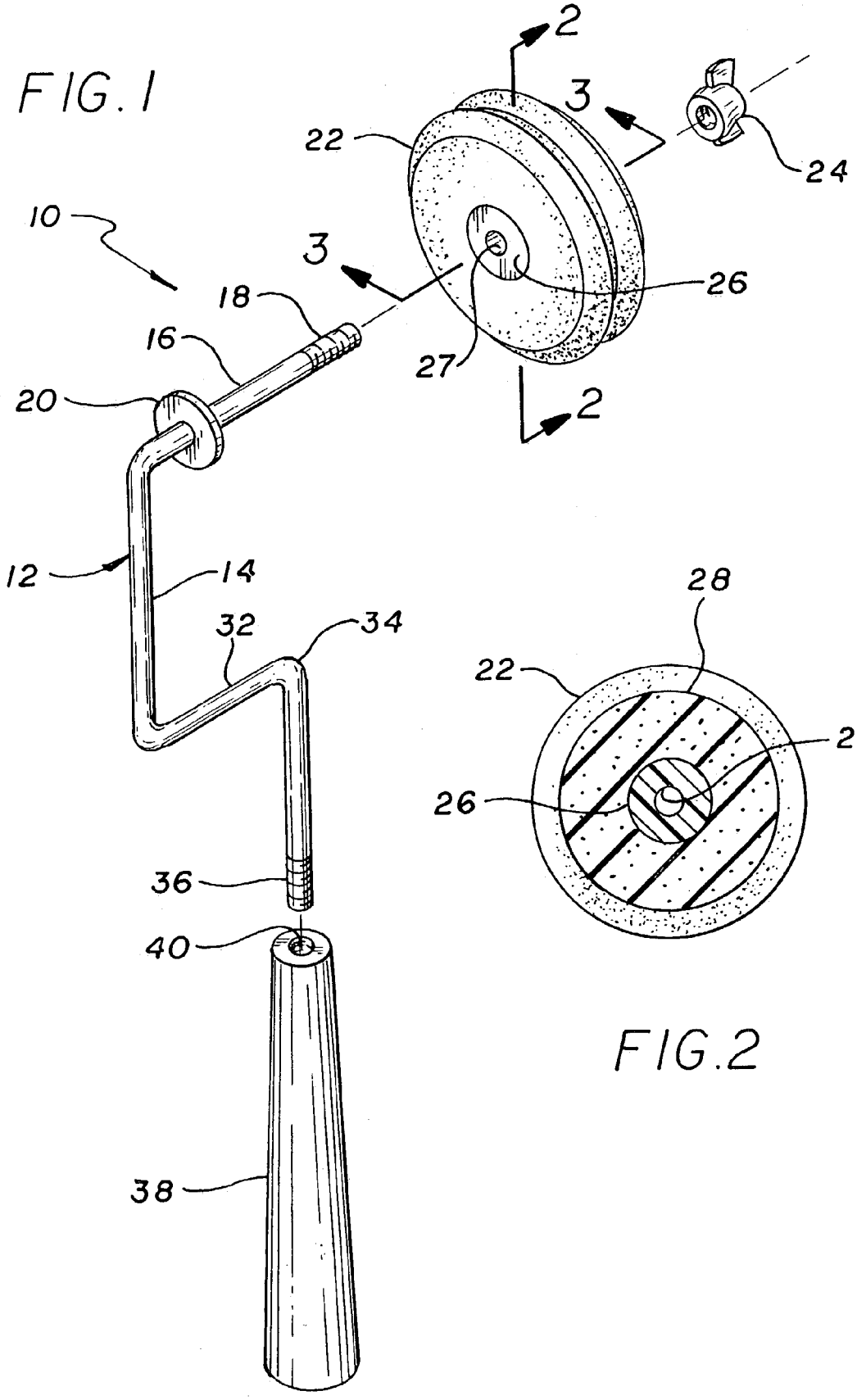
FIG. 1 is an exploded view of the roller version of the applicator assembly.
FIG. 2 is a cross-sectional view of the assembly illustrated in FIG. 1 taken along the line 2—2.
Figure 3:
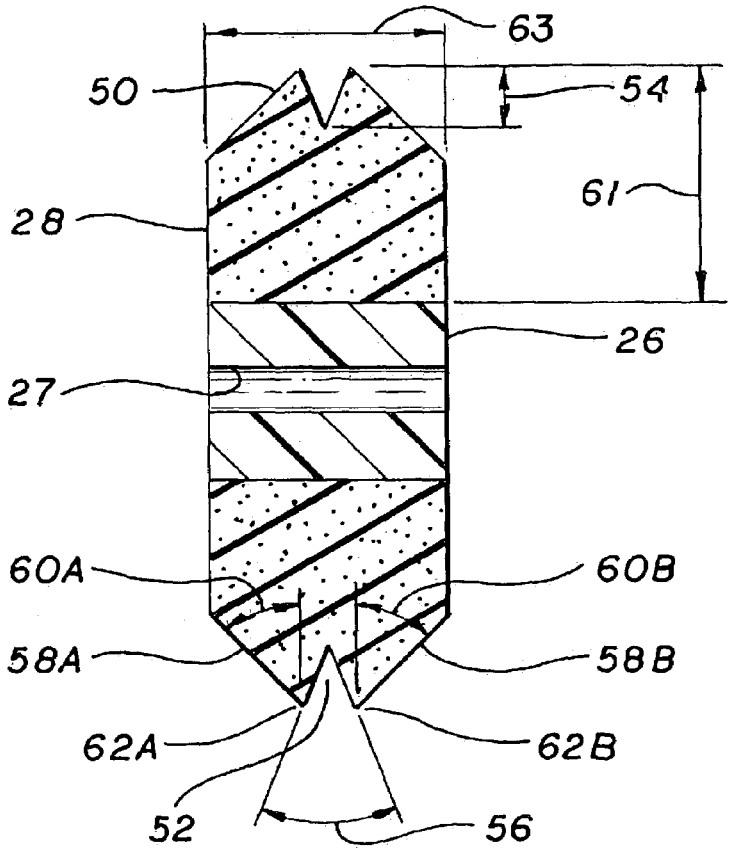
FIG. 3 is a cross-sectional view of the assembly illustrated in FIG. 1 taken along the line 3—3

Referring to FIGS. 1–3, the first embodiment of the coating applicator is in the form of a roller assembly, generally designated by numeral 10, The roller assembly includes a U shaped support frame 12 having a center leg 14 connected at one end to a side leg in the shape of a rod 16 acting as an axle. The rod 16 includes a flange 20 and a threaded end 18. A roller member 22 is rotatably mounted on the rod 16 retained thereon by flange 20 and a nut 24 engaging the threaded end 18. The roller member 22 includes a sleeve 26 having a hole 27 through which the rod 16 extends. Bonded to the exterior of the sleeve 26 is a foam coating applicator 28, which will be subsequently discussed in detail. Also attached to the center leg is a second side leg 32, which bends 90 degrees at its middle portion 34 and terminates in a threaded end 36. A handle 38 having an internally threaded end 40 is attached thereby to the threaded end 36. Thus the roller assembly so far described is conventional in design and other methods of attachment of the roller member 22 can be used.

Particularly referring to FIGS. 2 and 3, the foam coating applicator 28 is designed to easily imbibe the coating material and coat fasteners 42 installed in structures such as plate assembly 44. The fastener ends 46 protrude out of the plate assembly 44 with a height 47 and are secured by nuts 48. In order to properly coat the fastener ends 46 with a minimum of coating material, the peripheral end 50 of the foam coating applicator 28 has a W shape. The center V shaped notch 52 has a depth 54 and an included angle 56. The outer sides 58A and 58B are at acute angles 60A and 60B, respectively, leaving only small contact edges 62A and 62B.

In order to insure that the fastener ends 46 are properly coated in a one or two passes of the roller assembly 10, the applicator 28 should have the following dimensions: 1. Depth 54 of groove 52 is between 60 to 70 percent of fastener height 47; 2. Angle 56 is between 40 and 50 degrees; 3. Angles 60A and 60B between 40 and 50 degrees; and 4. Depth 61 of coating applicator is greater than 4 times the depth 54 of the groove 52. 5. Width 63 of coating applicator is not critical, but must be sufficient to prevent collapse upon application of the coating material. The foam should be open celled foam having a density of between 2 to 3 pounds per cubic foot. As previously stated, during coating, such a configuration will allow the coating member to deform sufficiently to completely engulf the fastener end and nut insuring that the imbibed coating material completely coats the fastener end and nut. Suitable foam is sold under the trade name Artilon®, manufactured by Youngbo America Incorporated, Huntington Beach, Calif.

Figure 4:
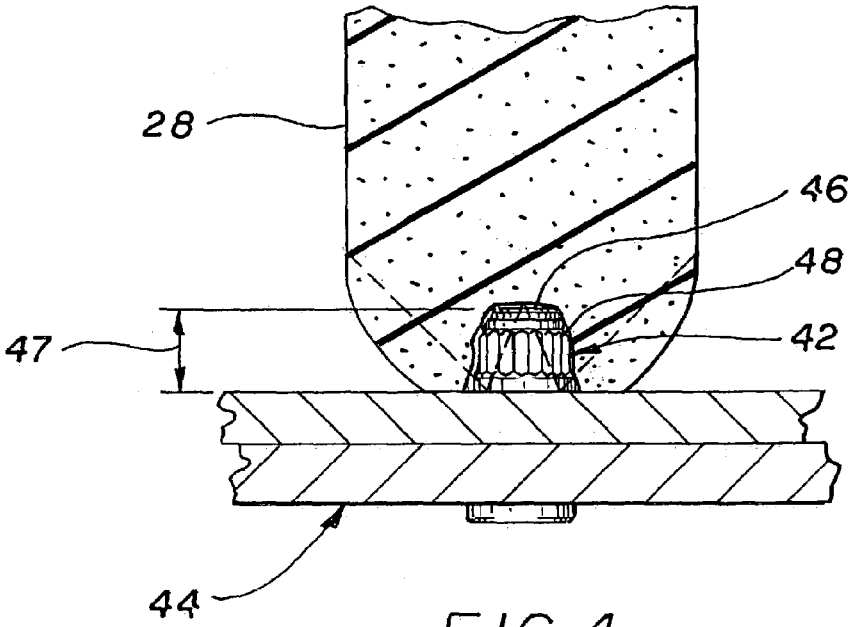
FIG. 4 is a is a view of the assembly shown in FIG. 1 applying a coating on a fasteners extending out of the surface of a structure.

As illustrated in FIGS. 4 and 5, when the roller 10 is pressed down over the fastener ends 46, the roller applicator 28 flattens such the notch 52 deforms about the fastener end 46 causing any imbibed coating material to completely coat the fastener end. Because only the flattened contact edges 62A and 62B remain in contact with the plate 44 between fasteners little coating material is deposited between the fasteners as indicated by numeral 64 in FIG. 5. Tests have demonstrated that's other shapes, such as notch or semi-circle or 90 V do not work.

A second embodiment is illustrated in to FIG. 6. Here the applicator assembly, generally indicated by numeral 70, is shown coating a fastener 72 in a corner of a structure 74. The applicator assembly 70 includes a simple handle 76 having a plate 77 at end 78. A block of foam 80 with a W shaped surface 82 is bonded to the plate 77. It is obvious that this applicator assembly 70 is ideally suited for such situations where a roller assembly could not be effectively used.

Figure 7:
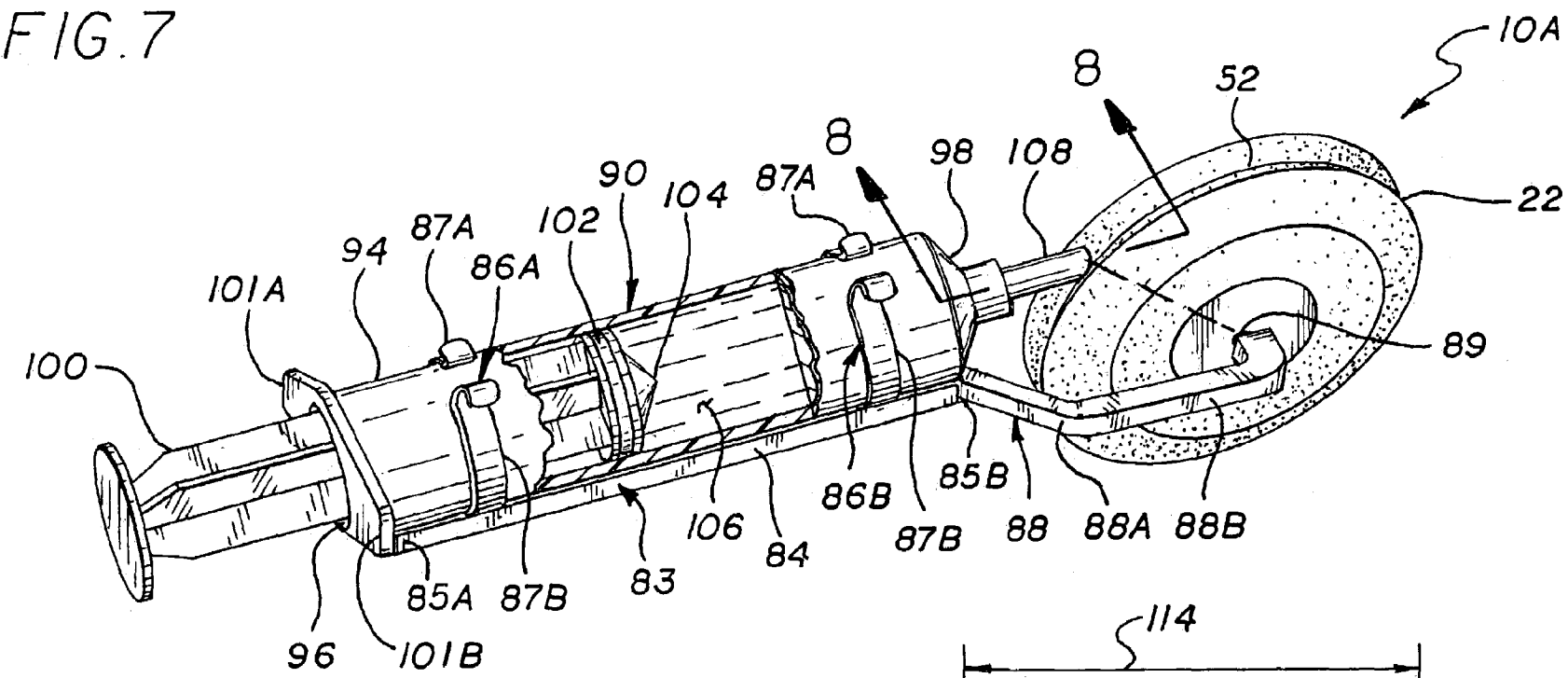
FIG. 7 is a perspective view of the applicator assembly shown in FIG. 1 incorporating a syringe for supplying the coating material directly to the applicator.
Figure 8:
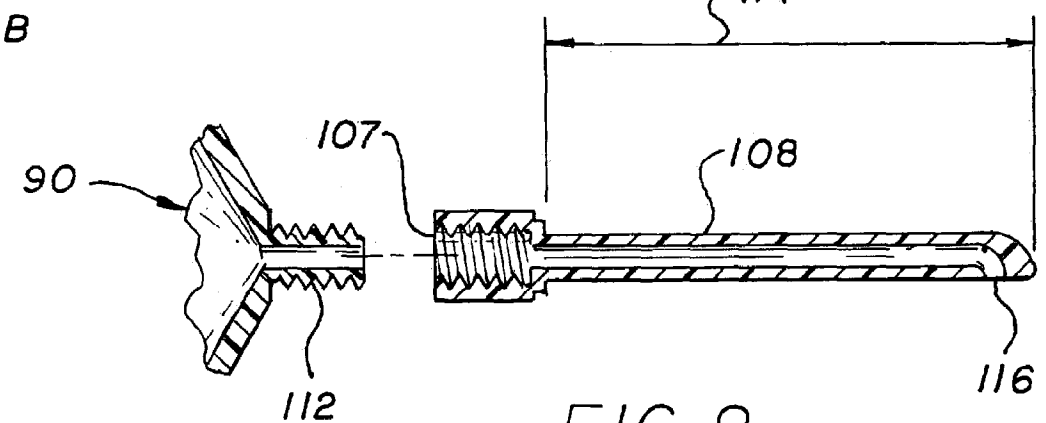
FIG. 8 is an enlarged partial cross-sectional view of FIG. 7 taken along the line 8—8 illustrating the nozzle configuration of the syringe.

The applicator assembly illustrated in FIGS. 1–4 can be improved by incorporating a coating material reservoir. Referring to FIGS. 6 and 7, a coating applicator 10A is depicted that is similar to coating applicator 10 except in the design of the support frame, now indicated by numeral 83. Here the support frame 83 includes a handle 84 having first and second ends 85A and 85B respectively. First and second U shaped spring clips 86A and 86B are mounted on the first and second ends 85A and 85B of the handle 84. Each of the U shaped spring clips includes side legs 87A and 87B. The support frame 83 includes a center leg 88 that has a first portion 88A that is bent side ways and second portion. 88B that is bent downward and joins to a rod 89, which serves as an axle for the roller member 22.

A syringe 90, preferably made of plastic material is used as a coating material reservoir. A 10 cubic centimeter capacity is ideal because it has an adequate capacity and can still be operated with one hand. The syringe 90 includes a hollow body 94 with an open first end 96 and closed off second end 98. The first end 96 of the plunger 100 incorporates flanges 101A and 101BA plunger 100 is movably mounted in the open first end 96. The plunger 100 has a seal 102 at end 104 within the body 94. Typically, the syringe is filled with a two-part coating 106 comprising a resin and catalyst mixed together. However, other coating materials can be used. The closed off second end 98 has a threaded hole 107 therein, in which a needle (not shown) would be normally installed. The syringe 90 includes a nozzle 108, which will be subsequently discussed. The syringe 90 is installed by pushing the body 94 of the syringe into engagement with the first and second U shaped members 86A and 86B such that the flanges 101A and 101B contact end 85A of the handle 83. Thereafter, the body 94 is pressed down until the legs 87A and 87B of both U shaped 86A and 86B lock the syringe in place. Other attachment methods are usable, such as just taping to the handle.

The nozzle 108 has an externally threaded end 112, which engages the threaded hole 107. The length 114 of the nozzle 108 as well as its shape is such that the outlet port 116 is within the notch 52 of the roller member 22 and is aligned with the axis of rotation thereof. Thus coating material 106 can be applied to the roller member 22 by pressing the plunger 100, which forces the coating material on to the W shaped peripheral end 50. As previously stated, the advantage of syringe is that coating material remains within the syringe until applied. With the original applicator assembly, a paint tray was necessary. This exposed the operator and any other individuals near by to fumes and possible contact with coating material when handling the tray or pouring coating material therein. Furthermore, the surface of the coating material in the tray tends to cure rapidly when exposed to air. The syringe 90 once loaded with a two part coating material can be stored at low-temperatures providing a shelf life of up to six months. This is advantageous, since a large number of syringes could be prepared at one time.

Figure 9:
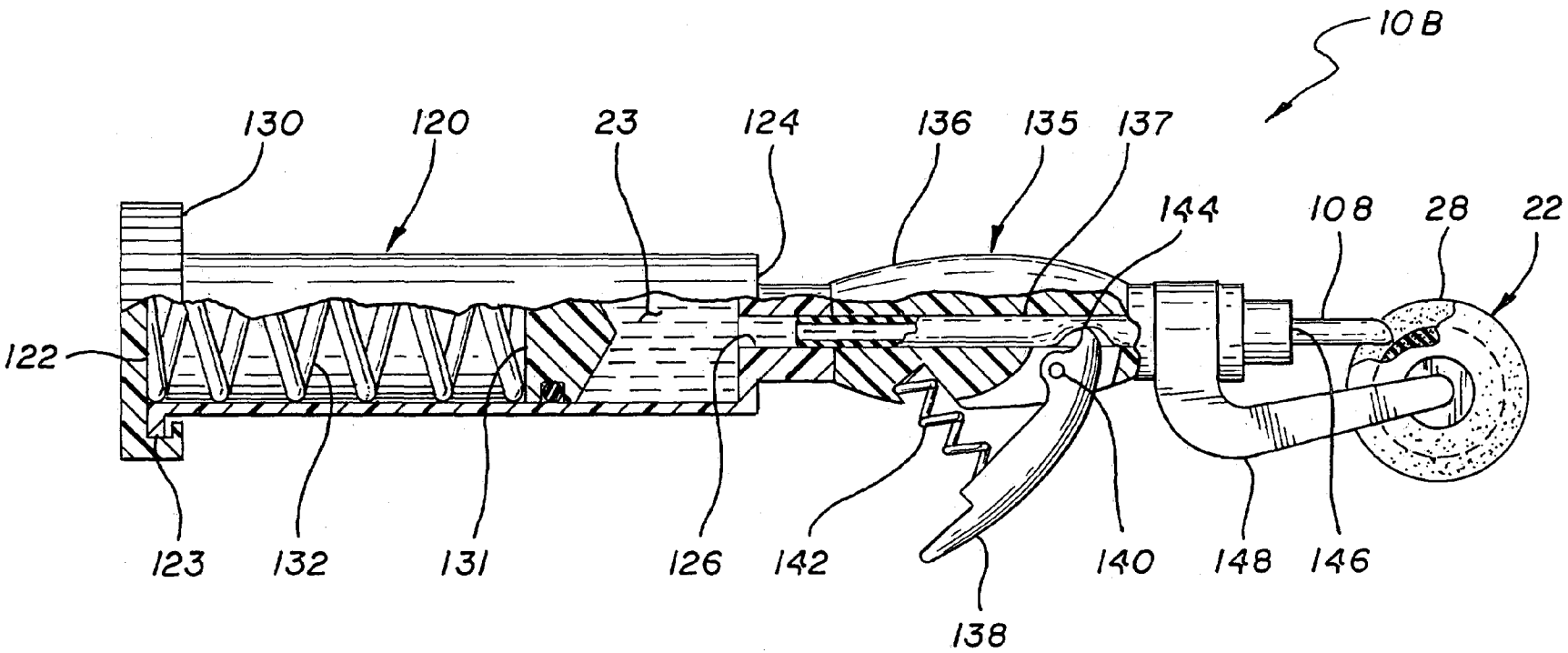
FIG. 9 is a partially broken away side view of a self-powered version of the applicator assembly.

A third version of the applicator assembly is illustrated in FIG. 9, generally indicated by numeral 10B. The Applicator assembly 10B includes a syringe 120 that includes an open first end 122 having a flange 123 and a closed off second end 124 having an aperture 126 therein. The syringe 120 includes a twist on cap 130, which locks on to the flange 123. A piston 131 is movably mounted within the syringe 120 biased toward the second end 124 by spring 132 positioned between it and the cap 130. Thus coating material 23 is pushed toward the aperture 126. A valve 135 includes a body 136 incorporating a plastic tube 137. A handle 138 is pivotally mounted to the body 136 and rotates about pivot axis 140. The handle 138 is biased by spring 142 such that the protrusion 144 on the handle normally crimps the tube 137 closing it off. When the handle 138 is pushed toward the body 136 the protrusion 144 disengages from the tube 137 allowing flow through output port 146.

The output port 146 of the valve 135 is connected to the nozzle 108, which applies coating material to the applicator 28 of the roller assembly 22. The applicator assembly 22 is rotatably mounted to arm 148 connected to the valve 135. This embodiment, with automatic feed can more easily operated with one hand. The particular valve 135 has been shown for purposes of illustration only, and there are numerous other types of valves that can be used. The valve depicted is a TS102D Dispensing Pen, manufactured by Techcon Systems, Garden Grove, Calif.

While the invention has been described with reference to particular embodiments, it should be understood that the embodiments are merely illustrative, as there are numerous variations and modifications, which may be made by those skilled in the art. Thus, the invention is to be construed as being limited only by the spirit and scope of the appended claims.

INDUSTRIAL APPLICABILITY

The invention has applicability to the paint industry.

The invention claimed is:

1. A coating applicator assembly for coating fasteners ends protruding from a surface of a structure, the fasteners extending a specific distance above the surface, the applicator assembly comprising:

a handle;

a coating member made from open celled compressible foam having a coating transfer surface in a W shape with a V shaped central notch, the V shaped notch having side walls extending at an angle of between 40 and 50 degrees away from each other and a depth of between 65 and 85 percent of the specific distance of the fasteners extending above the surface and the outer surfaces of the W shaped surface extending outward at an angle of between 40 and 50 degrees and the depth of coating member is at least 4 times the depth of the central notch.

2. The coating applicator assembly as set forth in claim 1 wherein said foam is and open celled foam having a density of between 2 and 3 pounds per cubic foot.

3. The coating applicator assembly as set forth in claim 1 wherein:

said handle includes an axle;

a drum rotatably mounted to said axles; and said coating member in the form of a ring mounted to said drum, the peripheral surface of said drum having said W shape with a V shaped central notch, the V shaped notch having side walls extending at an angle of between 40 and 50 degrees away from each other and a depth of between 65 and 85 percent of the specific distance of the fasteners extending above the surface and the outer surfaces of the W shaped surface extending outward at an angle of between 40 and 50 degrees and the depth of coating member is at least 4 times the depth of the central notch.

4. The coating applicator assembly as set forth in claim 3 wherein said foam is and open celled foam having a density of between 2 and 3 pounds per cubic foot.

5. A coating applicator assembly for coating fasteners ends protruding from a surface of a structure, the fasteners extending a specific distance above the surface, the applicator assembly comprising:

a handle;

a coating member made from open celled compressible foam having a coating transfer surface in a W shape with a V shaped central notch, the V shaped notch having side walls extending at an angle of between 40 and 50 degrees away from each other and a depth of between 65 and 85 percent of the specific distance of the fasteners extending above the surface and the outer surfaces of the W shaped surface extending outward at an angle of between 40 and 50 degrees and the depth of coating member is at least 4 times the depth of the central notch; and a syringe mounted to said handle, said syringe having a nozzle having an outlet port positioned to provide coating material to said coating transfer surface.

6. The coating applicator as set forth in claim 5 wherein said syringe is releasably mounted to said handle.

7. The coating applicator assembly of claim 6 wherein said output port of said nozzle is aligned with notch and the axis of rotation of said coating member.

8. The coating applicator assembly as set forth in claim 7 wherein said foam is and open celled foam having a density of between 2 and 3 pounds per cubic foot.

9. The coating applicator assembly as set forth in claim 8 wherein:

said handle includes an axle;

a drum rotatably mounted to said axles; and said coating member in the form of a ring mounted to said drum, the peripheral surface of said drum having said W shape.

10. The coating applicator assembly as set forth in claim 9 wherein said foam is and open celled foam having a density of between 2 and 3 pounds per cubic foot.

11. The coating applicator as set forth in claim 5, or or 6, or, or 7, or 8, or 9, or 10, comprising:

means to pressurize said syringe; and a valve positioned between said output port of said syringe and said nozzle for controlling the flow of the coating material.

* * * * *